United States Patent [19]

Winters et al.

[11] Patent Number: 4,586,711

[45] Date of Patent: May 6, 1986

[54] MATCHING CARD GAME EMPLOYING RANDOMLY-CODED MONOCHROMATIC IMAGES

[75] Inventors: Simon N. Winters, Toms River, N.J.; Yiu T. Chu, New York, N.Y.

[73] Assignee: Glenn E. Weeks, Fremont, Calif. ; a part interest

[21] Appl. No.: 493,170

[22] Filed: May 10, 1983

[51] Int. Cl.[4] ..... A63F 9/00

[52] U.S. Cl. ..... 273/138 R; 283/94; 434/121

[58] Field of Search ..... 273/139, 138 R; 283/72, 283/94, 98; 434/121; 400/124

[56] References Cited

U.S. PATENT DOCUMENTS

| | | | |
|---|---|---|---|
| 1,028,037 | 5/1912 | Lilleberg | 400/124 |
| 3,827,726 | 8/1974 | McVoy et al. | 283/94 X |
| 4,189,353 | 2/1980 | Harriman | 283/94 X |

OTHER PUBLICATIONS

IBM Technical Disclosure Bulletin, vol. 24, No. 2, 7–1981.

Newsweek, 10–1978, Gillette $1,000,000 World Series Bonus Offer.

Behavior Research Methods & Instrumentation, 1975, vol. 7, pp. 37–41: "Generation of Random–Dot Stereogratings", by Tyler et al.

*Primary Examiner*—Paul E. Shapiro

*Attorney, Agent, or Firm*—David Pressman

[57] ABSTRACT

A matching card game for supermarket contests and other encoding applications utilizes a positive sheet (10), preferably printed in a newspaper, and valid (16) and dummy (12) negative sheets, preferably made available in random order in the store, e.g., affixed to pads, on the wrappings of products, insertions into products, or printed on displays. The valid negative sheet, when placed over the positive sheet in correct registration, produces a recognizable, winning image (18), while similar superimposition of the dummy negative sheet will not produce any recognizable image (14). The sheets are formed by scanning (22) the image (20) to be encoded in a series of parallel adjacent rows. The positive and dummy sheets are printed as a series of rows of monochromatic, random, uniformly-shaped and sized geometric rectangles or other shapes. The negative sheet is similarly printed, except that in the pattern areas, the random rectangles are the inverse of those on the positive sheet in these areas. The non-pattern areas of all sheets preferably are printed by generating three sets of first random binary bits for these areas (34), generating random remainders of a pseudo-random number modulo a small positive integer, e.g., quaternary bits (36) for these areas, generating three sets of second random binary bits (38, 40, 42), one for each occurrence of a given one of the quaternary bits, modifying the three sets of first random binary bits according to the three sets of second random binary bits (44, 46, 48), respectively, and then printing (54, 60, 64) the pattern areas of the three sheets in accordance with the three modified bit signals.

16 Claims, 3 Drawing Figures

FEB 15 1983 DAILY NEWS 29

ADVERTISMENT ADVERTISMENT ADVERTISMENT

SNW- THE STORE FOR VALUES!

NOW PLAY OUR RADAR™ MATCHING GAME (SEE BELOW)

| BULK | | PRODUCE | |
|---|---|---|---|
| LENTILS | lb 17¢ | APPLES | lb 30¢ |
| BEANS | lb 28¢ | BANANAS | lb 17¢ |
| RICE | lb 35¢ | CELERY | lb 38¢ |
| ALMONDS | lb 99¢ | DAIKON | lb 15¢ |
| CEREAL | lb 58¢ | ENDIVE | lb $1.90 |

!FABULOUS PRIZES!

HOW TO PLAY OUR RADAR™ MATCHING GAME

TAKE THIS AD TO YOUR LOCAL SNW AND PICK UP A TRANSPARENT RADAR™ NEGATIVE SCANNER AT THE SOAP DISPLAY. PUT IT OVER THE RADAR POSITIVE BELOW AND SEE IF YOUR SCANNER BRINGS OUT OUR NAME-SNW. IF IT DOES, YOU WIN A FABULOUS PRIZE. PLAY AS OFTEN AS YOU LIKE—NO PURCHASE NECESSARY. LIMIT-ONE RADAR SCANNER PER VISIT.

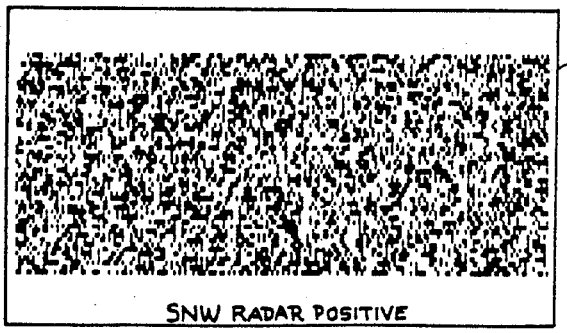

FIG 1
AD WITH POSITIVE PATTERN

COMBINING POSITIVE WITH RANDOM AND VALID NEGATIVES

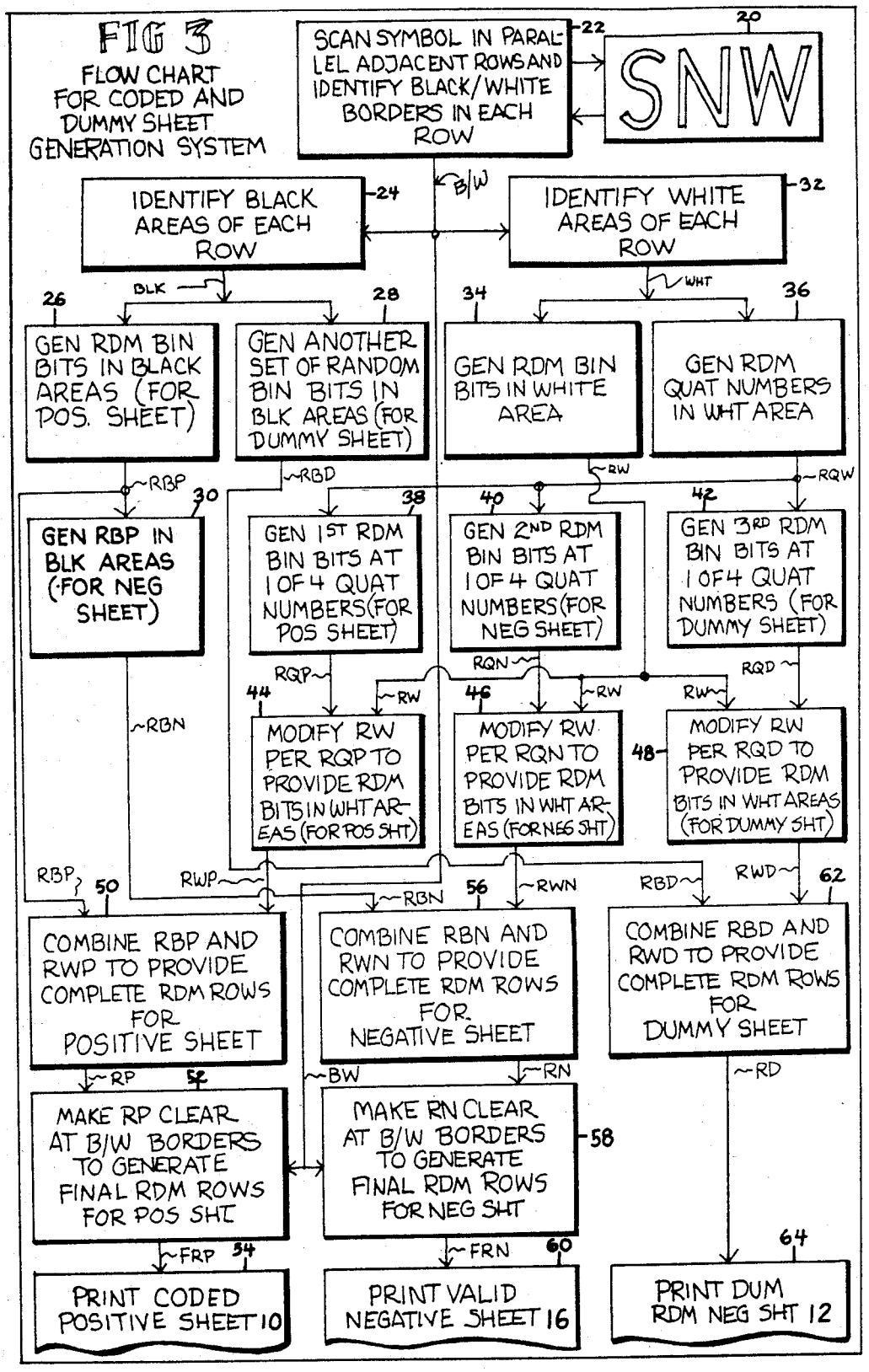
FIG 3
FLOW CHART FOR CODED AND DUMMY SHEET GENERATION SYSTEM
SCAN SYMBOL IN PARALLEL ADJACENT ROWS AND IDENTIFY BLACK/WHITE BORDERS IN EACH ROW
22
20
SNW
B/W
IDENTIFY BLACK AREAS OF EACH ROW
24
IDENTIFY WHITE AREAS OF EACH ROW
32
BLK
WHT
26
28
34
36
GEN RDM BIN BITS IN BLACK AREAS (FOR POS. SHEET)
GEN ANOTHER SET OF RANDOM BIN BITS IN BLK AREAS (FOR DUMMY SHEET)
GEN RDM BIN BITS IN WHITE AREA
GEN RDM QUAT NUMBERS IN WHT AREA
RBP
RBD
RW
RQW
30
38
40
42
GEN RBP IN BLK AREAS (FOR NEG SHEET)
GEN 1ST RDM BIN BITS AT 1 OF 4 QUAT NUMBERS (FOR POS SHEET)
GEN 2ND RDM BIN BITS AT 1 OF 4 QUAT NUMBERS (FOR NEG SHEET)
GEN 3RD RDM BIN BITS AT 1 OF 4 QUAT NUMBERS (FOR DUMMY SHEET)
RQP
RQN
RQD
RW
RW
RW
RBN
44
46
48
MODIFY RW PER RQP TO PROVIDE RDM BITS IN WHT AREAS (FOR POS SHT)
MODIFY RW PER RQN TO PROVIDE RDM BITS IN WHT AREAS (FOR NEG SHT)
MODIFY RW PER RQD TO PROVIDE RDM BITS IN WHT AREAS (FOR DUMMY SHT)
RBP
RWP
RBN
RWN
RBD
RWD
50
56
62
COMBINE RBP AND RWP TO PROVIDE COMPLETE RDM ROWS FOR POSITIVE SHEET
COMBINE RBN AND RWN TO PROVIDE COMPLETE RDM ROWS FOR NEGATIVE SHEET
COMBINE RBD AND RWD TO PROVIDE COMPLETE RDM ROWS FOR DUMMY SHEET
RP
52
BW
RN
RD
MAKE RP CLEAR AT B/W BORDERS TO GENERATE FINAL RDM ROWS FOR POS SHT
MAKE RN CLEAR AT B/W BORDERS TO GENERATE FINAL RDM ROWS FOR NEG SHT
58
FRP
54
FRN
60
64
PRINT CODED POSITIVE SHEET 10
PRINT VALID NEGATIVE SHEET 16
PRINT DUM RDM NEG SHT 12

MATCHING CARD GAME EMPLOYING RANDOMLY-CODED MONOCHROMATIC IMAGES

BACKGROUND

1. Field of Invention

This invention relates to a game of chance, particularly to a game of chance employing the assembly of two coded gamepieces to form or recover an original symbol or message. The game is particularly useful in applications involving advertising or promotion wherein game pieces are distributed to the public in connection with advertising and/or sales promotion campaigns.

2. Description of Prior Art

Heretofore many different types of chance games have been employed in advertising and/or sales promotion campaigns for the promotion of various products and services. However all of these games had limitations and drawbacks which restricted their applicability.

One type of matching card game employed a gamepiece or card which had a number or other symbol thereon, but which was hidden from discovery by a masking layer or overcoat of an opaque substance. The cards were distributed to the public who had to scrape or wash the overcoat off and then try to match the uncovered symbol with a predetermined winning symbol. This type of game often had the disadvantage of easy discovery since it was sometimes possible to hold the cards to the light and easily ascertain the covered symbol. Also the fabrication of the cards with the overlay coat was a relatively expensive operation, requiring the use of special printing equipment and techniques. Lastly, and perhaps most importantly, it was not possible to use economical regular newspaper advertising and printing to maximum potential advantage; the cards had to be distributed in a special manner, such as by far more expensive direct mail advertising or newspaper/magazine inserts.

Another type of such game employed coded gamepieces wherein a symbol was encoded by the use of complex color masking patterns. Decoding was done by the use of a colored overlay which filtered out certain masking lines and patterns so that the underlying pattern could be ascertained by visual inspection. This type of game was likewise expensive to fabricate because it also required special color printing techniques, special decoding masks, and special distribution means. Also the cards could be easily decoced if one had the colored overlay. Finally it was limited in its commercial scope to use in advertising and sales prommotion campaigns.

Other types of such games employed a plurality of gamepieces, each of which had a minor part of the message or symbol to be recovered, whereby users of the game had to collect and assemble a plurality of pieces to make the message or symbol(s) to be recovered. This type of game was also fraught with disadvantages of expense since many different printing runs, one for each of the different gamepieces, had to be employed. Also the gamepieces had to be distributed and printed by special means; it was not possible to provide the gamepieces as part of regular periodical advertisements since all copies had to be identical.

Various other types of matching games have been employed, but these also suffered from one or more of the above disadvantages and also had other disadvantages of their own.

OBJECTS AND ACHIEVEMENTS

Accordingly several objects and achievements of the invention are to provide a matching or chance card game or matching game which is economical to print and distribute, which is difficult or impossible to decode without employing proper gamepieces and playing the game in the predetermined manner, which employs gamepieces which can be distributed as part of regular periodical advertising and which does not require special mailings, or the like, which can be printed with regular printing equipment, which can be printed in monochromatic type and hence does not require color printing, and which does not require multiple printing runs with different respective copies.

Other objects and achievements are to provide a chance game where discoveryproof fraud detection means can be easily incorporated, which has a unique, attractive format, and which employs modern data processing techniques for economy and ease of fabrication. Further objects and advantages will become apparent from a consideration of the ensuing description in connection with the accompanying drawings.

DRAWINGS

FIG. 1 is a sample advertisement containing a positive pattern gamepiece according to the invention.

FIG. 3 is a flow chart illustrating how the gamepieces of the invention are fabricated.

FIG. 1—AD WITH POSITIVE PATTERN

Figure 2:
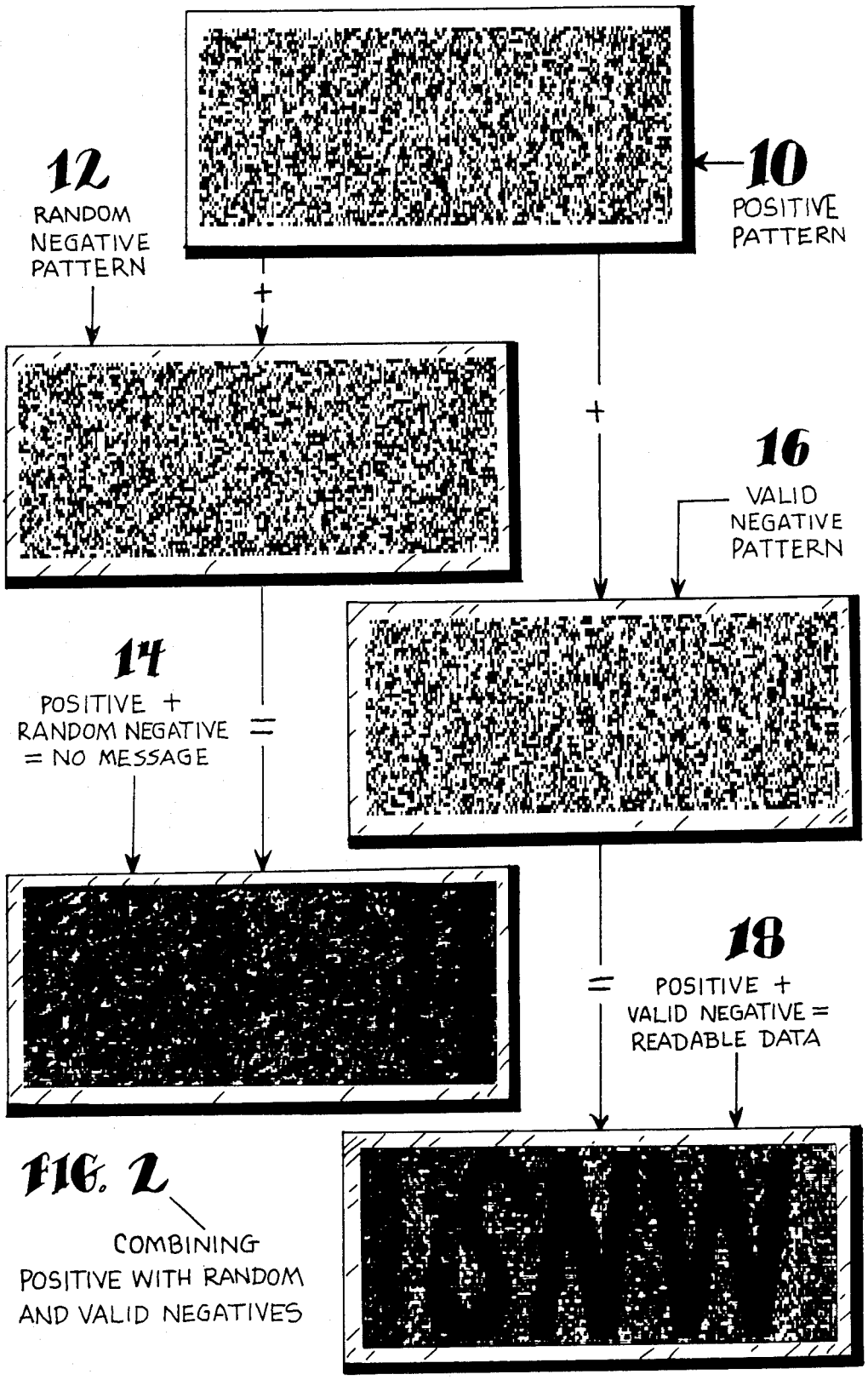
FIG. 2 is a diagram illustrating the gamepieces of the invention and how they are assembled (1) to provide a meaningful meassage, thereby to decode the intended symbol, and (2) to provide a non-message output, thereby failing to decode the intended symbol.

FIG. 1 shows an advertisement containing a "positive" gamepiece 10 according to the invention. The advertisement of FIG. 1 is exemplary only and is provided to illustrate how the public would first come in contact with the game, which also for illustrative purposes, is trademarked RADAR.

The ad of FIG. 1 is provided for a typical supermarket and contains sale prices of various sale items. At the top of the ad is a leader to direct the reader's attention to the gamepiece and instructions at the bottom. As indicated by the instructions, those who wish to play the game are to (1) take the ad to their store (here designated as an "SNW" store for exemplary purposes), (2) pick up a transparent (negative) RADAR "scanner" (shown in FIG. 2), (3) put the scanner over a RADAR positive 10 in the ad, and (4) see if the store's name ("SNW") is revealed. If so, the player of the game will win a prize.

Note that RADAR positive 10 in the ad is printed in black on white, thereby making it amenable to direct use in a newspaper advertisement without requiring special printing or inserts. Also it comprises a seemingly random pattern of black squares (on a white sheet) which conveys no information per se. Thus the reader of the ad who wishes to play the game must visit the SNW store in order to play the game. Because of the distinctive appearance of the positive gamepiece, and ad itself has a very distinctive appearance, which makes it easily-recognizable and thus directs a newspaper reader's attention to SNWs ad over others' ads.

FIG. 2—COMBINING POSITIVE WITH VALID AND RANDOM NEGATIVES

FIG. 2 illustrates the components of the invention and manner in which the chance game of the invention is played.

In FIG. 2, the positive pattern gamepiece of the ad of FIG. 1 is illustrated at 10, and, as stated, comprises a seemingly-random pattern of black squares on a white background. As indicated, the public or others who play the game would bring gamepiece 10, either clipped from or with the ad of FIG. 1, to the store or other place where the game is to be played.

A random pattern negative gamepiece 12 also comprises a random pattern of black squares, but on a transparent background or sheet. Gamepiece 12 would be handed out to the public or other players of the game at the SNW store. Gamepiece 12 has a truly random arrangement of black squares thereon and if matched with positive piece 10, will not produce any intelligible information, as illustrated at 14, which shows the result if random piece 12 is overlaid on positive piece 10.

In order to provide the usual small percentage of winners, most of the negative gamepieces printed and handed out at the store would be random negative (i.e., losing, dummy, or invalid) pieces such as 12.

Similarly a valid negative gamepiece 16 also comprises a seemingly-random pattern of black squares, also on a transparent background or sheet. Negative gamepiece 16 would also be handed out to the public or other players of the game at the SNW store. Gamepiece 16 has a pattern of black squares thereon which compliment those of piece 10, such that if piece 16 is overlaid on piece 10, the result will be the appearance of readable data, i.e., the SNW logo, as illustrated at 18.

Again, in order to provide the usual small percentage of winners, very few winning or valid pieces such as 16 would be printed or handed out at the store.

The dummy and valid gamepieces can be made available in random order in the store, e.g., on pads, or they could be imprinted on product wrappings, product inserts, or displays.

If a player of the game takes a positive piece 10 to the store and does receive a valid negative piece 16 which matches or compliments piece 10 so as to bring out the SNW logo, the player would call the match to the attention of the store's manager. Thereupon such player would be awarded a prize, in accordance with the predetermined rules of the game.

FIG. 3—FLOW CHART FOR CODED AND DUMMY SHEET GENERATION SYSTEM

The method of fabricating the three types of gamepieces according to the invention is illustrated in FIG. 3, which shows a flowchart of the steps involved in producing said pieces. The chart of FIG. 3 resembles, but is not a true computer programming flowchart, and is arranged to illustrate the fabrication principles of the invention most readily rather than faithfully follow conventional flowcharting standards. Also the flowchart presents a simplified description of the steps involved in fabrication of the gamepieces of the invention for facilitation of understanding; an accurate and complete presentation is provided in the flowcharts infra.

To start, the SNW logo is provided on a sheet 20 which is scanned (as indicated at 22) optically or electronically in parallel adjacent rows such that the locations of the black and white borders in each row are identified by column and row coordinates. The output of operation 22 will be a data file or electronic signal, identified as "B/W", which contains the coodinates of the black-to-white borders of each scanned row. I.e., sheet 20 is arbitrarily divided into many columns and rows and the data file produced as a result of the scanning operation indicates the column locations of each row where there is a black-to-white border between the black letters "SNW" and the white background.

The B/W file is processed (operation 24) to identify the black areas of each row, thereby to provide the output file or signal "BLK", which is indicative of the locations of the black areas of each row.

The BLK signal is processed or sampled at 26 to generate a set of pseudo-random (hereinafter random) binadry bits in each black area. These random binary bits in the black areas are used to generate the positive sheet and hence are identified as RBP (Random Binary Positive).

The BLK signal is also processed or sampled at 28 to generate another, independent set of random binary bits in each black area. This second set of random binary bits is used to generate the dummy or random pattern negative sheet and hence is identified as RBD (Random Binary Dummy).

The RBP (Random Binary Positive) signal from operation 26 is processed (block 30) to generate the inverse of the RBP signal for the valid negative sheet. This inverse signal is identified as RBN (Random Binary Negative).

Returning to scanning operation 22, the B/W signal is also processed (block 32) to identify the white areas in each row, which are indicated in the WHT output signal from block 32.

The WHT signal is then processed (block 34) to generate random binary bits for each white area, thereby to provide a RW (Random White) signal.

The WHT signal is also processed (block 36) to generate random remainders of a large pseudo-random integer modulo a small positive integer, e.g., quaternary numbers in each white area. These quaternary numbers may be repesented by the values 0 to 3; these are randomly assigned during each white area, as if a four-sided die (having the numbers 0 to 3 on its four respective sides) were thrown periodically, thereby to generate a file of 0's to 3's which occur randomly during each white area of each scanned row. The resultant signal is designated RQW (Random Quaternary White).

The RQW signal is processed in three operations, 38, 40, and 42, to substitute three independent sets of random binary bits for one of the four quaternary numbers.

Thus in operaton 38, each time a given one of the quaternary numbers, say a "2", occurs in the RQW signal, one of two binary bits (0 or 1) is randomly substituted. The other three of the quaternary bits (in the present example, the "0", "1", and "3") are discarded. The resultant binary signal is used for the positive sheet and is designated RQP (Random Quaternary Positive).

In operation 40 the RQW signal is similarly processed to independently generate a second random binary signal, one bit each time the same quaternary number ("2" in the present example) occurs. The resultant signal is used for the negative sheet and is designated RQN (Random Quaternary Negative).

In operation 42 the RQW signal is similarly processed to generate a third binary signal each time the same quaternary number occurs ("2" in the continuing example). The resultant signal is used for the dummy sheet and is thus designated RQD (Random Quaternary Dummy).

In operation 44 the RW signal from operation 34 is modified in accordance with the RQP binary signal to provide a random signal in the white areas. This signal, designated RWP (Random White Positive), will be used to generate the positive sheet.

The RWP signal is similar to the RW signal, i.e., a signal of random bits in the white areas, except that it is modified by the RQP signal such that 25% of the bits in this signal are further randomized by a binary signal so as effectively to cause sufficient visual differentiation in the white areas among the positive, negative, and dummy frames. Simultaneously this guarantees some positive percentage of common white dots or squares when the dummy sheets overlay each other properly. A high positive percentage of white dots or squares makes it easy to discover the hidden message when the positive overlays the mating negative. The quaternary numbers used in operation 38 guarantee such a high positive percentage, thereby making it easy to discover the hidden message when a player has a winning combination.

Similarly in operation 46 the RW signal is modified by the RQN signal to provide a second differentiating random signal in the white areas, this one for the negative sheet. Hence it is designated RWN (Random White Negative). It is similar to the RWP signal, except that the binary signal which modifies 25% of the bits is separately generated.

Again and similarly, in operation 48 the RW signal is modified by the RQD signal to provide a third differentiating random signal in the white areas, this one for the dummy sheet. This signal is designated RWD (Random White Dummy) and is similar to the RWP and RWN signals except that, again, the binary signal which modifies 25% of the bits is independently generated in a third operation.

Returning to the black signal path, the RBP signal is combined with the RWP signal in operation 50 to provide complete random rows for generating the positive sheet.

To review, the RBP signal (operation 26) is a randomly-generated set of bits in each black area of each row and the RWP signal (operation 44) is a randomly-generated, but slightly differentiated set of bits in each white area of each row. It is slightly differentiated in actual content, but visually appears greatly different. Combining these two random bit signals (operation 50) reconstructs each row, but as a set of random bits which in and of themselves do not provide enough information to indicate the locations of the black areas of each row. The resultant signal is designated RP (Random Positive).

In operation 52 the RP signal is made clear at the black/white borders of each row to generate final random rows for the positive sheet. The locations of these B/W (black to white) borders are provided by the B/W signal, which is processed in operation 52 with the RP signal. The operation of block 52 is done to insure that when the final positive sheet (10 of FIGS. 1 and 2) overlays the final negative sheet (12 of FIG. 2) the shapes will be well-defined at the B/W borders, whereby it will be easy to tell if a match or winning combination has occurred. The output of operation 52 is a FRP (Final Random Positive) signal.

The FRP signal from operation 52 is then processed in to operation 54 where this signal is used to print coded positive sheet 10 of FIGS. 1 and 2.

Again returning to the black signal path, in operation 56 the RBN signal (the inverse of the RBP signal) is combined with the RWN signal to provide complete rows for generation of the valid negative sheet. The output signal from block 56 is designated RN (Random Negative).

The RN signal is similarly made clear in operation 58 at the B/W borders to generate the final random rows for the negative sheet. The Final Random Negative (FRN) signal is one which when combined with the FRP signal will generate or reconstruct the original pattern 20.

In operation 60 the FRN signal is used to print the valid negative sheet (16 of FIG. 2).

Again returning to the black signal path, the RBD (Random Binary Dummy) signal from operation 28 is combined, in operation 62, with the RWD signal to generate a complete random signal for generation of the rows of the dummy negative sheet. This signal is designated RD (Random Dummy) and is a truly random signal in that it contains no information about the locations of the B/W borders of original pattern 20.

The RD signal is then processed in to operation 64 where it is used to print the dummy or random negative sheet.

It can thus be seen from FIGS. 1 and 2 that the patterned or "code" portion of each sheet contains a plurality of uniform areas thereover, each of which is either black, white, or transparent. Each of the areas has the same shape and size and the areas are contiguous so that they occupy the entire surface of said code portion of each sheet. Some of the black (contrast) and transparent or white ("other") areas on the sheets occupy adjacent ones of the uniform areas so that each resultant set of adjacaent contrast and "other" areas will form larger contrast and "other" areas.

DETAILS OF AND INSTRUCTIONS FOR OPERATIONS OF FIG. 3

The operations of FIG. 3 preferably are performed with the aid of data processing equipment in the following manner.

The logo to be encoded is drawn or otherwise reproduced in a suitable size and placed on a digitizing tablet and digitized in a conventional manner. The digitizing tablet will generate an output data file (arbitrarily designated GRAPTST.INP) which as the locations of the black and white borders of the logo. The GRAPTST-.INP file, when printed, will actually be a series of rows of data, each row taking the form

R N1 D N2 S N3 D N4 S N5 D N6 where R indicates Row, N1 is the number of the row, D indicates the start of a Dark or black area, N2 is the number of the column at the start of this black area, S indicates the Stop or end of the black area, N3 is the number of the column where this black area stops, etc.

Alternatively the input or scansion data file may be generated with a flying spot scanner, manually, or by any other suitable means.

Then, using an Onyx C8002 CPU (Cenral Processing Unit) and a Televideo 925 CRT (Cathode Ray Tube) video terminal, a Unix operating system, and the program GRAPSHOW.C (listed infra), the file GRAPTST.INP is processed or executed. This operation will generate the following three output data files: GRAPTST.POS, which is the FRP file of FIG. 3 and constitutes the data for generating coded positive sheet 10, GRAPTST.NEG, which is the FRN file of FIG. 3 and constitutes the data for generating the coded negative sheet 16, and GRAPTST.NOS, which is the RD file of FIG. 3 and which constitutes the data for generating dummy, random, or "noise" negative sheet 12.

For efficient programming considerations, the GRAPSHOW.C program will actually generate five different RD files, which are interspersed with regularity in a single GRAPTST.NOS file, in order to provide five different random pattern negative sheets 12. Thus many dummy sheets 12 can be provided for playing the game. The program NTHREAD.C (listed infra) reconstitutes each individual RD file from the information interspersed in GRAPTST.NOS.

The above three output data files are then printed with an Okidata SL250 graphics printer using the above computing apparatus and the GRAPCOMP.C program (also listed infra). Positive coded sheet 10 is printed on a white sheet. Valid negative sheet 16, dummy negative sheet 12, and the other dummy negative sheets (not shown), are printed on a transparent sheet, e.g., of cellophane, celluloid, polyetyhelene, or the like. The negative sheets may easily be printed on the transparent sheets by first printing them on paper (opaque) sheets and then transferring the images to transparent sheets by photographic or xerographic processes. The program DELAY.C (listed infra) slows printing to insure that the printer will not overheat.

The programs infra (discussed above) are written in "C", a programming language detailed in the book, "The C Programming Language" by Kernighan and Ritchie (Prentice-Hall 1978). The names of the programs and files are spelled with upper-case letters to make them stand out in this document, but in practice they are spelled with lower-case letters.

As stated, the flowchart of FIG. 3 presents a simplified version of the fabrication of the gamepieces of the invention, while the following programs detail the actual fabrication steps accurately according to the presently-preferred embodiment thereof. According to the programs infra, symbol 20 is scanned and processed one row at a time to provide encoded row signals, and then the complete FRP, FRN, and RD signals are assembled from the resultant encoded individual row signals.

While the above description contains many specificities, these should not be construed as limitations on the scope of the invention, but rather as an exemplification of a preferred embodiment thereof. Many other variations and ramifications of the invention as described will be envisioned by those skilled in the art. For example, the positive and negative sheets can be reversed so that two types of positive sheets are provided (dummy and valid) and only one negative sheet is provided. Accordingly the full scope of the invention should be determined, not by the embodiment given, but by the appended claims and their legal equivalents.

GRAPSHOW.C 1/3

```
#include    <stdio.h>
#define          MAXNOS  5
#define          SEED    15271
#define          MAX10   399
#define          MAXPR   133
main()           /*      grapshow.c      */
{
    FILE    *fp, *fppos, *fpneg, *fpnos, *fp110, *fppos10, *fpneg10;
    static  char    line[MAXPR], inp[MAXPR], pos[MAXPR], neg[MAXPR],
            nos[MAXNOS][MAXPR];
    static  char    enq = 05, inw[MAXPR];
    static  int     buff[MAX10], lst, bufpos[MAX10], bufneg[MAX10],
            bufnos[MAXNOS][MAX10];
    static  char    cs[] = { 64, 112, 76, 124, 67, 115, 79, 127, 106 };
    int     row = 0, r, tocol, type, col, cmax = 90,
            colfr, tofr, c, num, l, n;
    int     diff[MAXNOS], flip, seed = SEED, torow, value,
            cbmax = MAX10 - 1, cb, clast;

    fprintf (stderr, "\n\n(C) Copyright 1983 Y. Ting Chu, ");
    fprintf (stderr, "Glenn E. Weeks, and Simon N. Winters\n");
    fprintf (stderr, "All Rights Reserved\n\n");
    for (n = 0; n < MAXNOS; n++)
            diff[n] = 0;
    srand(seed);
    fp = fopen ("graptst.inp", "r");
    fppos = fopen ("graptst.pos", "w");
    fpneg = fopen ("graptst.neg", "w");
    fpnos = fopen ("graptst.nos", "w");
    fp110 = fopen ("graptst.110", "w");
```

```
fppos10 = fopen ("graptst.pos10", "w");
fpnes10 = fopen ("graptst.nes10", "w");
line[0] = pos[0] = nes[0] = end;
for (n = 0; n < MAXNOS; n++)
        nos[n][0] = end;
for (c = 1; c < cmax; c++) {
        line[c] = pos[c] = nes[c] = 64;
        for (n = 0; n < MAXNOS; n++)
                nos[n][c] = 64;
}
line[cmax] = pos[cmax] = nes[cmax] = '\0';
for (n = 0; n < MAXNOS; n++)
        nos[n][cmax] = '\0';
fprintf (stderr, "start pos:");
scanf ("%d", &lst);
if (lst < 1)
        lst = 3;
while ( fscanf (fp, "%s%d ", inw, &num) != EOF) {
        if (row <= 0)
                row = num - 2;
        type = inw[0];
        switch (type) {
        case 'r':
                fprintf (stderr, "case %s , num = %d ", inw, num);
                torow = num;
        clast += 3;
        l = lst;
        for (c = 0; c < clast; c += 3, l++) {
                value = buff[c]*4 + buff[c+1] * 2 + buff[c+2];
                line[l] = cs[value];
                value = bufpos[c]*4 + bufpos[c+1]*2 + bufpos[c+2];
                pos[l] = cs[value];
                value = bufnes[c]*4 + bufnes[c+1]*2 + bufnes[c+2];
                nes[l] = cs[value];
                for (n = 0; n < MAXNOS; n++) {
                        value = bufnos[n][c]*4 + bufnos[n][c+1]*2
                                + bufnos[n][c + 2];
                        nos[n][l] = cs[value];
                }
        }
        line[l] = pos[l] = nes[l] = '\0';
        for (n = 0; n < MAXNOS; n++)
                nos[n][l] = '\0';
        for ( r = row; r < torow; r++) {
                fprintf (fppos, "%s\n", pos);
                fprintf (fpnes, "%s\n", nes);
                for (n = 0; n < MAXNOS; n++) {
                        fprintf (fpnos, "%s\n", nos[n]);
                }
                pr10 (fpl10, buff, clast);
                pr10 (fppos10, bufpos, clast);
                pr10 (fpnes10, bufnes, clast);
        }
        row = torow;
        tocol = colfr = value = 0;
        col = 0;
```

```
        for (cb = 0; cb < cbmax; cb++) {
                buff[cb] = bufpos[cb] = bufneg[cb] = 0;
                for (n = 0; n < MAXNOS; n++)
                        bufnos[n][cb] = 0;
        }
        break;
case 'd':
        for (c = col + 1; c <= num; c++) {
                flip = rand() & 0001;
                buff[c] = bufpos[c] = bufneg[c] = flip;
                for (n = 0; n < MAXNOS; n++) {
                        diff[n] = rand() & 0003;
                        bufnos[n][c] = flip;
                }
                if (diff[0] <= 0) {
                        flip = rand() & 0001;
                        buff[c] = bufpos[c] = flip;
                        flip = rand() & 0001;
                        bufneg[c] = flip;
                }
                for (n = 0; n < MAXNOS; n++) {
                        if (diff[n] <= 0) {
                                flip = rand() & 0001;
                                bufnos[n][c] = flip;


                                }
                        }
                }
                c = col + 1;
                buff[c] = bufpos[c] = bufneg[c] = 0;
                c = col = num;
                buff[c] = bufpos[c] = bufneg[c] = 0;
                clast = num;
                break;
        case 's':
                for (c = col + 1; c <= num; c++) {
                        buff[c] = 1;
                        flip = rand() & 0001;
                        bufpos[c] = flip;
                        bufneg[c] = ~ flip & 0001;
                        for (n = 0; n < MAXNOS; n++) {
                                flip = rand() & 0001;
                                bufnos[n][c] = flip;
                        }
                }
                clast = num;
                col = num;
                break;
        }
}
exit(0);
}
```

```
#include   <stdio.h>
#define          MAXNOS  5
main()           /*      grapcomp.c      */
{
   FILE    *fp, *fp1;
   static  char    *files[] = {"graptst.pos", "graptst.neg", "graptst.nos"};
   char    line[133], buff[133];
   static  char    cs[] = { 64, 112, 76, 124, 67, 115, 79, 127, 106 };
   int     i, c, ln, bn, or, w, nth, k, frame, n, rep, rec;
   struct  timeb *otp, *ntp;
   long    milsec;

   fprintf (stderr, "\n\n(C) Copyright 1983 Y. Ting Chu, ");
   fprintf (stderr, "Glenn E. Weeks, and Simon N. Winters\n");
   fprintf (stderr, "All Rights Reserved\n\n");
   fprintf (stderr, "print line timing delay in milli seconds: ");
   scanf ("%ld", &milsec);
   fprintf (stderr, "\n");
   if (milsec < 10L)
           milsec = 10L;
   for (i = frame = 0; i < 3; i++) {
           fp = fopen (files[i], "r");
           if (i <= 1)
                   nth = 1;
           else    nth = MAXNOS;
           for (n = 0; n < nth; n++) {
                   rewind (fp);
                   rec = 0;
                   while (nthread(line, 133, fp, n, nth) != NULL) {
                           for (rep = 0; rep < 2; rep++) {
                                   printf ("%s", line);
                                   delay (milsec);
                           }
                   }
                   if (++frame % 3 == 0)
                           printf ("\n\n\f");
           }
           fclose (fp);
   }
   printf ("\n\n\f");      frame = 2;
   for (i = 0; i < 3; i++) {
           if (i == 0) {
                   fp = fopen (files[0], "r");
                   fp1 = fopen (files[1], "r");
           }
           else if (i == 1) {
                   fp = fopen (files[0], "r");
                   fp1 = fopen (files[2], "r");
           }
           else {
                   fp = fopen (files[1], "r");
                   fp1 = fopen (files[2], "r");
           }
           if (i <= 0)
                   nth = 1;
```

```
            else    nth = MAXNOS;
            for (n = 0; n < nth; n++) {
                    printf ("\n\nc%d-%d\n", i, n);
                    rewind (fp);
                    rewind (fp1);
                    rec = 0;
                    while (fgets (line, 133, fp) != NULL) {
                            if (nthread (buff, 133, fp1, n, nth) == NULL)
                                    break;
                            line[0] = 05;
                            for (c = 1; line[c] != '\n'; c++) {
                                    if (line[c] == buff[c])
                                            continue;
                                    for (ln = 0; ln < 8; ln++) {
                                            if (cs[ln] == line[c])
                                                    break;
                                    }
                                    for (bn = 0; bn < 8; bn++) {
                                            if (cs[bn] == buff[c])
                                                    break;
                                    }
                                    or = (ln | bn) & 0007;
                                    line[c] = cs[or];
                            }
                            line[c] = '\n';
                            for (rep = 0; rep < 2; rep++) {
                                    printf ("%s", line);
                                    delay (milsec);
                            }
                    }
            if (++frame % 3 == 0)
                    printf ("\n\n\f");
            }
    }
    exit(0);
}
```

NTHREAD.C

```
#define     MXBUF   1024
#include    <stdio.h>
char        *nthread (line, maxch, fp, nrec, nset)
    /* read nrecth from nset of records */
char        line[];
int maxch, nrec, nset;
FILE        *fp;
{
    int     i;
    char    buf[MXBUF], *rfs, *ret;
    /*       (stderr, "\n\n(C) Copyright 1983 Y. Tins Chu, ");      */
    /*       (stderr, "Glenn E. Weeks, and Simon N. Winters\n");    */
    /*       (stderr, "All Rights Reserved\n\n");   */

    if (nset < 1)
            nset = 1;
    if (nrec < 0)
            nrec = 0;
```

```
    for (i = 0; i < nset; i++) {
            rfs = fsets (buf, maxch, fp);
            if (rfs == NULL) {
                    buf[0] = '\0';
                    return (NULL);
            }
            if (i == nrec) {
                    ret = rfs;
                    strcpy (line, buf, maxch);
            }
    }
    return (ret);
}
```

DELAY.C

```
#include    <sys/types.h>
#include    <sys/timeb.h>
delay (milsec)              /*      delay.c */
long        milsec;
{
    struct  timeb otp, ntp;
    long    thousec, unitsec, elapse;
    int     loop;

    /*      (stderr, "\n\n(C) Copyright 1983 Y. Ting Chu, ");       */
    /*      (stderr, "Glenn E. Weeks, and Simon N. Winters\n");     */
    /*      (stderr, "All Rights Reserved\n\n");    */
    ftime (&otp);
    for (loop = 0; loop < 1234567L; loop++) {       /* milli second delay */
            ftime (&ntp);
            thousec = (long)(ntp.time - otp.time)*1000L + (long)ntp.millitm;
            elapse = thousec - (long)(otp.millitm);
            if (elapse > milsec) {
                    break;
            }
    }
}
```

We claim:

1. A matching card game for restoring an original symbol, said game comprising positive, dummy-negative, and valid-negative gamepieces, said game being arranged so that registration of said dummy-negative gamepiece over said positive gamepiece will not produce any intelligible information, but so that registration of said valid-negative gamepiece over said positive gamepiece will produce a viewable image of said original symbol, said card game comprising:

(a) a positive gamepiece comprising a first sheet of material having a pattern of monochromatic uniform geometric figures arranged thereon in a random manner in an area corresponding to the area of said original symbol so as to represent a part of said original symbol in said area, said geometric figures also being arranged in a random manner in the areas of said first sheet other than that of said original symbol, such that said first sheet of material will not, in itself, provide any intelligible information upon direct viewing thereof, (b) a negative gamepiece comprising a second sheet of material having a pattern of monochromatic uniform geometric figures, arranged in a random manner in an area corresponding to the area of said original symbol so as to represent another part of said original symbol in said area, said geometric figures also being arranged in a random manner in the areas of said second sheet other than that of said original symbol, such that said second sheet of material will not, in itself, provide any intelligible information upon direct viewing thereof, (c) said monochromatic uniform geometric figures of said positive and said negative gamepieces being distributed in the areas thereof corresponding to the area of said original symbol such that when said negative gamepiece is superimposed in a predetermined manner of registration over said positive gamepiece, the monochromatic uniform geometric figures of both will combine and compliment each other in the area occupied by said original symbol so as to reconstitute said symbol in said area, and so that the other areas of said sheets will have a reduced coverage from said monochromatic geometric symbols so as to enable said reconstituted symbol to be humanly recognized, and (d) a dummy gamepiece comprising a third sheet of material having a pattern of monochromatic uniform geometric figures arranged in a random manner in an area corresponding to the area of said original symbol and the other surrounding areas of said third sheet, such that said third sheet of material does not contain any intelligible information upon direct viewing thereof and so that, if superimposed upon said first sheet, said original symbol will not be reconstituted or provided, regardless of the manner of registration of said dummy gamepiece with said first sheet.

2. The game of claim 1 wherein said monochromatic uniform geometric figures of each of said sheets are rectangular in shape.

3. The game of claim 1 wherein said monochromatic uniform geometric figures of each of said sheets are substantially black, the other areas of said second sheet being transparent, the other areas of said first sheet being substantially white.

4. The game of claim 1 wherein said monochromatic uniform geometric figures of each of said sheets are arranged in rows and columns which are uniform on each of said sheets.

5. A method of fabricating playing sheets for a chance game comprising the following steps:

(a) providing a humanly-recognizable two-dimensional pattern, (b) scanning said pattern in adjacent parallel rows to compile the locations of the border areas of said pattern in each scanned row, (c) generating for each row a first series of random binary elements, (d) generating for each row a second series of binary elements, (e) said first and second series of binary elements being generated such that the portion of said second series of binary elements corresponding to said pattern is the inverse of that of said first series of binary elements for said pattern, the pattern of binary elements of said second series for the portion of each row not within said pattern being random, (f) printing a positive coded sheet in response to said first series of random binary elements, said positive coded sheet consisting of rows of elements corresponding to said rows in which said pattern was scanned, the elements of said rows being uniformly-shaped monochromatic geometric figures corresponding to said first series of random binary elements in each row, (g) printing a negative coded sheet in accordance with said second series of random binary elements, said negative coded sheet consisting of rows of elements corresponding to said rows in which said pattern was scanned, the elements of said rows being monochromatic, uniformly-shaped geometric figures corresponding to said second series of binary elements in each row, and (h) printing at least one dummy coded sheet consisting of rows of elements corresponding to said rows in which said pattern was scanned, the elements of said rows being monochromatic, uniformly-shaped geometric figures having a random distribution.

6. The method of claim 5 wherein said elements on said positive, negative, and dummy sheets are printed in rectangular shapes and wherein the areas of each of said sheets, other than those occupied by said elements, are also composed of rectangular elements of the same shape and size as said elements.

7. The method of claim 5 wherein said elements on said posisive, negative, and dummy sheets are made substantially black, and wherein the areas of said positive sheet, other than said elements, are made substantially white, and wherein the areas of said negative and dummy sheets, other than said elements, are made substantially transparent.

8. The method of claim 5 wherein the binary elements for said first and second series for said portion of each row not within said border areas of said pattern are generated by generating a primary series of random binary bits for said non-pattern portion of each row, generating a series of random bits of an order higher than binary for said non-pattern portion of each row, generating a secondary series of random binary bits, one for each occurrence of a predetermined one of said higher than binary bits, generating a ternary series of random binary bits, one for each occurrence of said predetermined one of said higher than binary bits, modifying the non-pattern portions of said first series of random binary elements according to said secondary series of random binary bits, modifying the non-pattern portions of said second series of random binary elements according to said ternary series of random binary bits, and printing said positive and negative coded sheets in response to said modified first and second series of random binary elements, respectively.

9. The method of claim 8 further including generating for each row a third series of random binary elements, generating a quaternary series of random binary bits, one for each occurrence of said predetermined one of said quaternary bits, modifying said third series of random binary elements according to said quaternary series of random binary bits, and printing said dummy coded sheet in response to said modified third series of random binary elements.

10. The method of claim 5 wherein said negative coded sheet is formed on a transparent sheet of material, said elements thereon being black, and wherein said positive coded sheet is formed on a subtantially opaque sheet of material, said elements thereon being black.

11. The method of claim 10 wherein said transparent sheet of material is a film negative and wherein said opaque sheet of material is white and contains advertising indicia thereon.

12. A chance game in which a winner is able to match a chosen or assigned playing piece with a universally-distributed playing piece to assemble a predetermined complete and intelligible pattern, said playing pieces comprising:

(a) first and second sheets of material, (b) at least a portion of each of said sheets constituting a code portion and having a plurality of uniform geometric figures thereover, each of said figures having the same geometric shape and size, said figures being contiguous so as to occupy the entire surface of said code portion of each sheet, (c) some of said uniform figures on said first sheet being monochromatic contrast areas which are
(1) substantially opaque to light, and
(2) arranged in positions so that in themselves they do not provide a complete or intelligible symbol, (d) some of said monochromatic contrast areas on said first sheet occupying contiguous uniform areas so that each resultant set of contiguous monochromatic contrast areas will form a unitary monochromatic contrast area larger than a single uniform area, (e) some of said uniform figures on said second sheet being monochromatic contrast areas which
(1) have a substantially different light reflectivity than the others and remainder of the uniform areas on said second sheet, and
(2) are arranged in positions so that in themselves they do not provide a complete or intelligible symbol, (f) some of said monochromatic contrast areas on said second sheet occupying contiguous uniform areas so that each resultant set of contiguous monochromatic contrast areas will form a unitary monochromatic contrast area larger than a single uniform area, (g) some of said others of said uniform figures on said second sheet also occupying contiguous uniform areas so that each resultant set of contiguous other figures on said second sheet will form a unitary other area larger than a single uniform area, (h) the remainder of said uniform figures of said first sheet, other than said monochromatic contrast figures thereon, being substantially transmissive of light, such that at least some of said monochromatic contrast areas on said second sheet can be viewed through said light-transmissive areas of said first sheet when said first sheet is superimposed over said second sheet in a predetermined manner of registration, (i) some of said others of the uniform figures on said second sheet also occupying contiguous ones of said uniform areas so that each resultant set of contiguous other areas on said first sheet will form a unitary other area larger than a uniform area, (j) said monochromatic contrast areas on said first and second sheets each also containing encoded information of said of pattern such that when said first sheet is superimposed over said second sheet in said predetermined manner of registration, said monochromatic contrast areas of both sheets will combine and compliment each other when viewed in a direction perpendicular to said sheets so as to present said pattern in complete and intelligible form assembled of complimentary parts of said monochromatic contrast areas of said first and second sheets, (k) said monochromatic contrast and the others of said uniform figures on said first sheet being distributed in a random fashion, (l) said monochromatic contrast and the others of said areas on said second sheet also being distributed in a random fashion and having a complimentary arrangement to that of the monochromatic contrast areas of said first sheet in the portions of said sheets which present said pattern, and (m) said monochromatic contrast areas of said first sheet having a non-complimentary arrangement to that of the monochromatic contrast areas of said second sheet in the portions of said sheets other than those portions which present said pattern, (n) all monochromatic contrast and other areas on both sheets thereby having the same uniform shape and size, occupying the entire code portion of each said sheets, and providing large contrast and large other areas where contiguous contrast areas and contiguous other areas exist, whereby when said first and second sheets are superimposed in said predetermined pattern of registration, the coded image can be assembled more rapidly, with less tolerance, and with less possibility for error.

13. The game of claim 12 wherein said monochromatic contrast areas and said other areas of each sheet are rectangular in shape.

14. The game of claim 12 wherein said monochromatic contrast areas of each sheet are substantially black, the other areas of said first sheet being transparent, the other areas of said second sheet being substantially white.

15. The game of claim 12 further including at least one dummy sheet having an arrangement of monochromatic contrast areas thereon which have said uniform geometric shape and size and which are distributed in a random fashion.

16. The game of claim 12 wherein said uniform figures of both sheets are arranged in rows and columns which are substantially identical on both sheets.

* * * * *